US006340215B1

(12) United States Patent
Yamakita

(10) Patent No.: US 6,340,215 B1
(45) Date of Patent: Jan. 22, 2002

(54) ELONGATED-STRIP-ARTICLE PROCESSOR

(75) Inventor: Yoshimichi Yamakita, Uozu (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/327,852

(22) Filed: Jun. 8, 1999

(30) Foreign Application Priority Data

Jun. 19, 1998 (JP) ..... 10-173515

(51) Int. Cl.[7] ..... B41J 3/00
(52) U.S. Cl. ..... 347/4
(58) Field of Search ..... 347/4, 3, 22, 101, 347/104, 105, 2; 101/126; 400/58, 56; 355/202

(56) References Cited

U.S. PATENT DOCUMENTS 5,345,863 A * 9/1994 Kurata et al. ..... 347/4

FOREIGN PATENT DOCUMENTS

JP 03069658 * 3/1991 ..... 347/3

* cited by examiner

*Primary Examiner*—John Barlow
*Assistant Examiner*—Charles W. Stewart, Jr.
(74) *Attorney, Agent, or Firm*—Finnegan, Henderson, Farabow, Garrett & Dunner, L.L.P.

(57) ABSTRACT

An elongated-strip-article processor comprises: a processing section for applying printing to a plurality of continuous elongated strip articles along conveying passages of the elongated strip articles by an ink jet printer; a conveying section disposed in a vicinity of the processing section for intermittently conveying the elongated strip articles by a predetermined length; tension adjusting sections respectively disposed upstream and downstream out of a range of the conveying passages including the processing section and the conveying section for adjusting tension of each of the elongated strip articles at a constant value; sensors respectively provided at the tension adjusting sections for detecting a length of slack of each of the elongated strip articles; and feed sections disposed respectively upstream of the upstream-side tension adjusting section and downstream of the downstream-side tension adjusting section so as to correspond to the individual elongated strip articles. Each of the feed sections is adapted to switch between a state of positively feeding each elongated strip article and a state of suppressing feed of each elongated strip article based on detection signals from the respective sensors. By the elongated-strip-article processor, a plurality of elongated strip articles on an ink jet printer or the like can be accurately conveyed with optimum tension for the respective articles.

10 Claims, 2 Drawing Sheets

ELONGATED-STRIP-ARTICLE PROCESSOR

BACKGROUND OF THE INVENTION

1. Field of the Invention

The present invention relates to an elongated-strip-article processor mounted to an ink jet printer or the like for moving the elongated strip article, such as a fastener or the like, to be printed.

2. Description of the Related Art

Japanese Patent Laid-open Publication No. 3-69658 and Japanese Patent Laid-open Publication No. 5-330085 respectively discloses an ink jet printer for applying printing to the elongated strip article such as a fastener or a surface fastener. The ink jet printer comprises a processor for conveying the elongated strip article to be printed. This type of elongated-strip-article processor has conveying passages for a plurality of elongated strip articles, the passages being arranged in a substantially horizontal posture below print heads having ink jet nozzles. A driving roller abuts on one faces of the elongated strip articles and follower rollers abut on the driving roller via the elongated strip articles, thereby advancing the elongated strip articles at a predetermined speed intermittently by predetermined lengths for printing. The driving roller is mounted on only one side of the print head relative to a conveying direction of the elongated strip articles as disclosed in Japanese Patent Application Laid-open No. 3-69658, or mounted on both sides of the print head as disclosed in Japanese Patent Application Laid-open No. 5-330085.

In the above prior art, the ink jet printer can clearly print fine patterns, but there has been a problem that the printed patterns are disarranged on a product if the elongated strip article is slackened or stretched. Particularly when a plurality of elongated strip articles are mounted to the ink jet printer, because the respective elongated strip articles are slackened or excessively stretched in different states, each of the elongated strip articles needs to be brought into an optimum state by individual adjustment when conveyed. However, it has been difficult to easily adjust a tension per each elongated strip article.

SUMMARY OF THE INVENTION

The present invention has been accomplished with above prior art in view. So, it is an object of the invention to provide an elongated-strip-article processor which can accurately convey a plurality of elongated strip articles on an ink jet printer respectively with optimum tensions.

To achieve the above object, according to the invention, there is provided an elongated-strip-article processor including a processing section for applying printing to a plurality of continuous elongated strip articles along conveying passages of the elongated strip articles by an ink jet printer and a conveying section which is disposed in a vicinity of the processing section for intermittently conveying the elongated strip articles by a predetermined length. The processing section may include a print head and a drier unit of the ink jet printer, and the conveying section may be a print roller for conveying the elongated strip articles.

The elongated-strip-article processor further includes tension adjusting sections, such as dancer rollers, disposed upstream and downstream out of a range of the conveying passages including the processing section and the conveying section for adjusting tension of each of the elongated strip articles at a constant value, and sensors respectively provided at the tension adjusting sections as the dancer rollers.

Each of the dancer rollers moves up or down according to a length of slack of the elongated strip article in contact with the dancer roller. The sensors detect the length of slack of each elongated strip article by detecting positions of the dancer rollers. Further, the processor includes feed sections disposed respectively upstream of the upstream-side tension adjusting section and downstream of the downstream-side tension adjusting section so as to correspond to the individual elongated strip articles. Each of the feed sections switches between a state of positively feeding each elongated strip article and a state of suppressing feed of each elongated strip article based on detection signals from the respective sensors.

Each of the feed sections further includes a driving roller disposed under the elongated strip articles and having a rotation axis perpendicular to a feed direction of the elongated strip articles, at least one retainer disposed under the elongated strip articles and in parallel to the driving roller for retaining the elongated strip articles, a plurality of follower rollers disposed above the elongated strip articles and in parallel to the driving roller, and a plurality of retaining members above the elongated strip articles so as to face the retainer via the elongated strip articles, the follower rollers or the retaining members being adapted to be alternatively pressed against the driving roller or the retainer so as to clamp the elongated strip articles between the follower rollers and the driving roller or between the retaining members and the retainer. For example, each pair of the follower roller and the retaining member are respectively and rotatably attached to opposite ends of a single actuator having a rotation shaft substantially at a center of the actuator. The actuator has at one end portion thereof a moving means, such as an air cylinder, for pivotally moving or swinging the actuator about the rotation shaft and for pressing the follower roller or the retaining member against the driving roller or the retainer via each of the elongated strip article.

The retainer of the feed section may be a driving roller disposed in parallel to the first-mentioned driving roller and rotating at a lower speed than the first-mentioned driving roller. In this case, the follower roller is also pressed against the second-mentioned driving roller.

Each of the driving rollers may be a single roller with respect to a plurality of elongated strip articles. The numbers of the follower rollers and the moving means thereof disposed above the driving rollers may correspond to the number of the plurality of elongated strip articles conveyed in parallel to each other.

In the elongated-strip-article processor of the invention, the elongated strip articles are conveyed by predetermined intermittent conveyance. If a feed amount of each elongated strip article becomes larger than that intermittent conveying amount so that a length of each elongated strip article becomes excessive, the corresponding dancer roller moves down. Then, the corresponding sensors detect that the dancer roller has reached its lower limit position, and a signal is transmitted to the corresponding moving means such as a cylinder. Then, the cylinder moves the corresponding retaining member or the corresponding follower roller to move down to be pressed against the corresponding retainer, or to be pressed against one of the corresponding driving rollers rotating at a lower rotation speed through the elongated strip article. Thus, the elongated strip article is retained by the retaining member or conveyed slowly by the slow driving roller and the follower roller. As a result, the feed amount of the elongated strip article decreases, so that the dancer roller does not further move down. As a result, the length of the elongated strip article gradually decreases, and the corresponding dancer roller moves up.

If the corresponding dancer roller moves up to reach its upper limit position, the corresponding sensors detect that the dancer roller has moved up and a signal is transmitted to the moving means such as a cylinder. Then, the cylinder moves, such that the corresponding follower roller moves down to be pressed against the other one of the corresponding driving rollers rotating at a higher rotation speed through the elongated strip article. Thus, the elongated strip article is conveyed by that driving roller and the follower roller. As a result, the feed amount of each elongated strip article from a feed bobbin increases, and the dancer roller does not move up, so that the length of each elongated strip article gradually increases, and the corresponding dancer roller moves down. Thus, tension of the elongated strip article can be maintained at a constant value at the processing section.

As mentioned above, the dancer rollers move between the lower limit position and the upper limit position which is sufficient to give each elongated strip article a length of slack, for preventing the elongated strip article from begin excessively tight or loose between the intermittent conveying section and the feed section. Further, the tensions of the elongated strip articles are adjusted by predetermined weights of the dancer rollers so that abnormal fluctuations of the tensions can not occur.

DESCRIPTION OF THE PREFERRED EMBODIMENT

An embodiment of the present invention will be described below with reference to the drawings. A processor of the embodiment is an ink jet printer comprising conveying passages arranged in a substantially horizontal posture for conveying elongated strip articles to be printed, below a print head having ink jet nozzles as a processing section. A plurality of elongated strip articles are retained in parallel to each other on the conveying passages by a feed unit 1 and are respectively carried at predetermined speeds.

Figure 1:
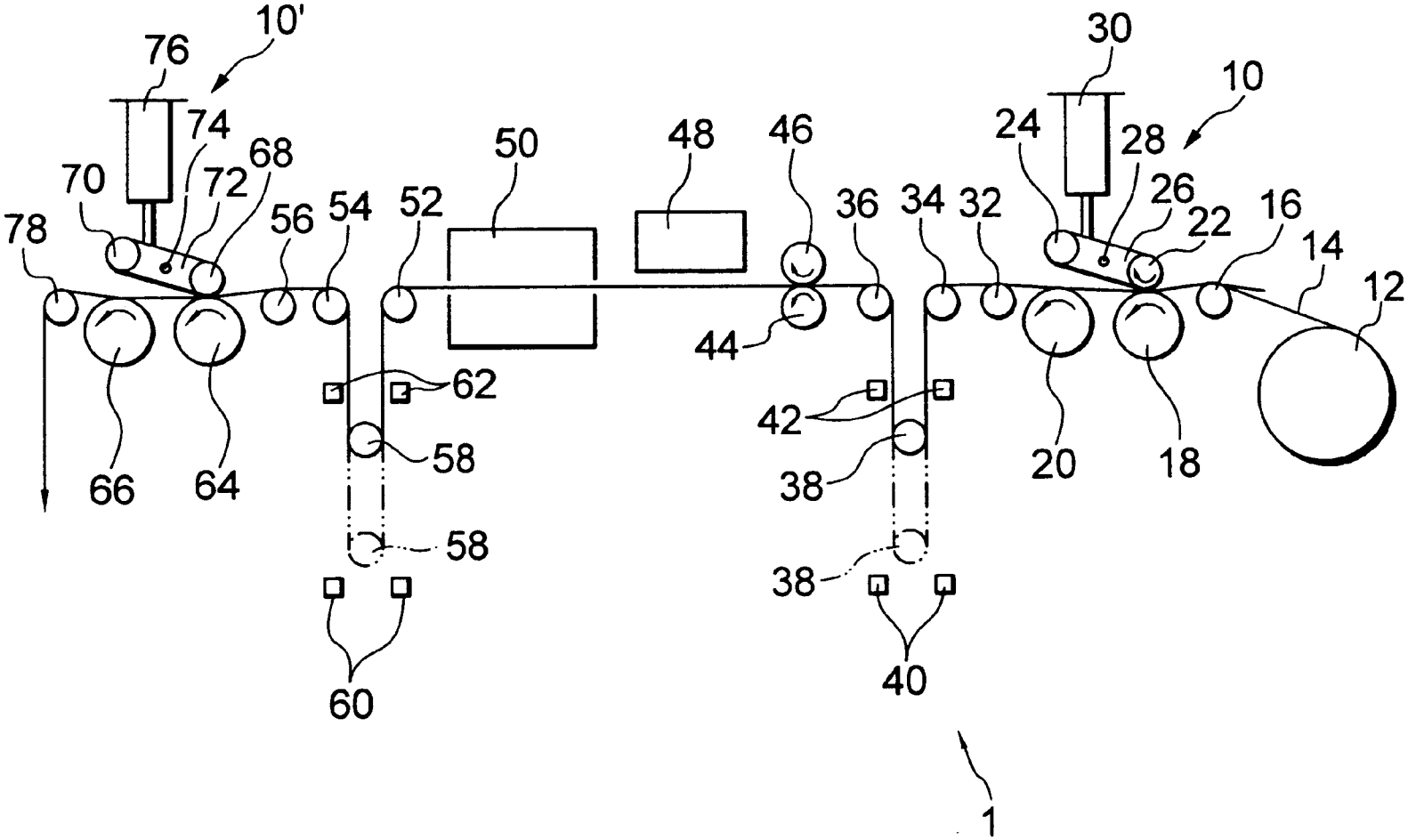
FIG. 1 is a schematic view showing an embodiment of an elongated-strip-article processor according to the present invention.

As shown in FIG. 1, the feed unit 1 has a roller 16 in contact with lower sides of a large number of elongated strip articles 14 fed in parallel to each other from a feed bobbin 12. The roller 16 rotatably follows the feed of the elongated strip articles 14 and maintains feeding positions of the elongated strip articles at predetermined positions. A first driving roller 18 and a second driving roller 20 which constitute a feed section 10 of the elongated strip articles 14 are disposed downstream in the feeding direction of the roller 16 and under the elongated strip articles 14, the first and second driving rollers 18 and 20 being spaced by a predetermined distance. The second driving roller 20 is driven at a lower speed than the first driving roller 18. The single first driving roller 18 and the single second driving roller 20 are arranged respectively in a direction perpendicularly to the feed direction of the large number of elongated strip articles 14.

At positions which face the first driving roller 18 through the elongated strip articles 14, first follower rollers 22 which respectively correspond to the elongated strip articles 14 and are short in axial directions are rotatably disposed. At positions which face the second driving roller 20 through the elongated strip articles 14, second follower rollers 24 which respectively correspond to the elongated strip articles 14 and are short in axial directions are rotatably disposed. Each pair of the first follower rollers 22 and the second follower roller 24 are attached to a long and narrow plate-like retaining plate 26. The axial directions of the first follower rollers 22 and the second follower rollers 24 are in parallel to each other. The first and second follower rollers 22 and 24 are arranged in an axial direction substantially perpendicularly to the feed direction of the elongated strip articles 14. The respective pair of the first and second follower rollers 22, 24 are attached substantially perpendicularly to side faces of the retaining plate 26, and are respectively positioned at opposite end portions of the retaining plate 26 in a longitudinal direction of the retaining plate 26. A pivotal shaft 28 is provided penetrating a center of the retaining plate 26 in a direction perpendicular to the feed direction of the elongated strip articles 14. The retaining plate 26 is retained for a pivotal or swinging movement by the pivotal shaft 28. Between the pivotal shaft 28 of each retaining plate 26 and each second follower roller 24, a cylinder 30 as a moving means for individually swinging each the retaining plate 26 is mounted.

Rotatable rollers 32, 34, and 36 are disposed downstream of the second driving roller 20, at the same level as the roller 16, and spaced at predetermined intervals, while being in contact with the lower sides of the elongated strip articles 14. Between the rollers 34 and 36, dancer rollers 38 which constitute tension adjusting sections are respectively mounted to be in contact with the upper sides of the elongated strip articles 14. The dancer rollers 38 are at arbitrary positions lower than the rollers 34 and 36 move up or down according to lengths of slack of the elongated strip articles 14. In spaces above and below the respective dancer rollers 38, there are respectively arranged first sensors 40 which are sensors for detecting the dancer rollers 38 when the dancer rollers 38 are at lower limit positions and second sensors 42 for detecting the dancer rollers 38 when the dancer rollers 38 are at the upper limit positions are respectively mounted. Further, there is mounted a controller (not shown) for transmitting signals for actuating the cylinders 30 when the dancer rollers 38 are detected by the first sensors 40 or the second sensors 42.

An intermittent driving roller 44 which constitutes a conveying section is disposed at the same level height as the roller 36 is mounted downstream of the roller 36 to be in contact with the lower sides of the elongated strip articles 14. At a position facing the intermittent driving roller 44 through the elongated strip articles 14, an intermittent follower roller 46 is mounted for intermittently conveying the elongated strip articles 14 by a set length. Above the elongated strip articles 14 with a predetermined distance from the articles 14, a print head 48 having ink jet nozzles (not shown) is mounted downstream of the intermittent driving roller 44. Further, a drier unit 50 for drying and hardening printed ink is mounted downstream of the print head 48.

Rotatable rollers 52, 54, and 56 are disposed downstream of the drier unit 50, at the same level as the roller 16, and spaced at predetermined intervals, while being in contact with the lower sides of the elongated strip articles 14. Between the rollers 52 and 54, dancer rollers 58 are mounted to be in contact with the upper sides of the respective elongated strip articles 14. Each of the dancer rollers 58 has the same weight as each of the upstream dancer rollers 38.

The dancer rollers 58 are at arbitrary positions lower than the rollers 52 and 54 and move up or down according to lengths of slack of the elongated strip articles 14. In spaces above and below the respective dancer rollers 58, there are respectively arranged third sensors 60 for detecting the dancer rollers 58 when the dancer rollers 58 are at lower limit positions and fourth sensors 62 for detecting the dancer rollers 58 when the dancer rollers 58 are at the upper limit positions are respectively mounted. Further, there is mounted a device for transmitting signals for actuating cylinders 76 which will be described later when the dancer rollers 58 are detected by the third sensors 60 or the fourth sensors 62.

Each of the dancer rollers 38, 58 move between the lower limit position and the upper limit position which is sufficient to give each elongated strip article 14 a length of slack, for preventing the elongated strip article 14 from being excessively tight or loose between the intermittent conveying section 44, 46 and the feed section 10. Further, the tensions of the elongated strip articles 14 are adjusted by predetermined weights of the dancer rollers 38, 58 so that abnormal fluctuations of the tensions can not occur.

A third driving roller 64 and a fourth driving roller 66 similar to the first driving roller 18 and the second driving roller 20 are mounted downstream of the roller 56. The rollers 64, 66 are arranged under the elongated strip articles 14, at positions slightly lower than the roller 16 and spaced at a predetermined distance from each other. The fourth driving roller 66 is driven at a lower speed than the third driving roller 64. At positions which face the third driving roller 64 through the elongated strip articles 14, third follower rollers 68 which respectively correspond to the elongated strip articles 14 and are short in axial directions are rotatably disposed. At positions which face the fourth driving roller 66 through the elongated strip articles 14, fourth follower rollers 70 which are short in axial directions are rotatably disposed. Similarly to the first follower rollers 22 and the second follower rollers 24, each pair of the third follower rollers 68 and the fourth follower roller 70 are attached to a long and narrow plate-like retaining plate 72. The axial directions of the third follower roller 68 and the fourth follower roller 70 are substantially perpendicular to side faces of the retaining plate 72, and the third and fourth follower rollers 68 and 70 are respectively positioned at opposite end portions of the retaining plate 72 in a longitudinal direction of the retaining plate 72. A pivotal shaft 74 is provided to penetrate a center of the retaining plate 72. The retaining plate 72 is retained by the pivotal shaft 74 for a pivotal or swinging movement. Between the pivotal shaft 74 of each retaining plate 72 and each fourth follower roller 70, a cylinder 76 for swinging the retaining plate 72 is mounted. A rotatable roller 78 is mounted downstream of the fourth driving roller 66 at the same level as the roller 16. The elongated strip articles 14 are folded by the roller 78 and taken up by a take-up roller (not shown).

Figure 2:
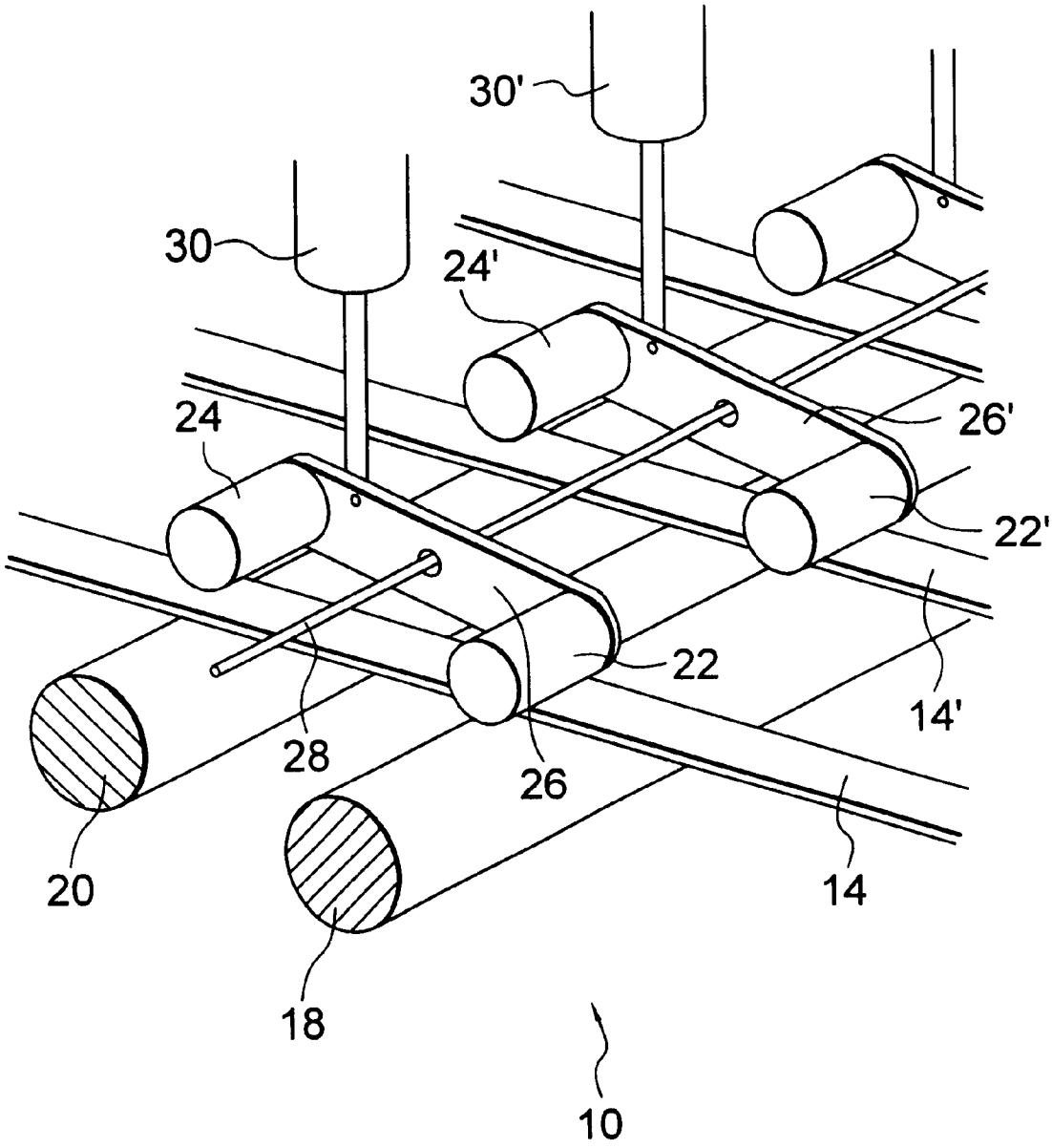
FIG. 2 is a perspective view of the elongated-strip-article processor of this embodiment.

In the above-mentioned feed unit 1, a plurality of elongated strip articles 14, 14', . . . are laid in parallel to each other in axial directions of the rollers as shown in FIG. 2. The first follower rollers 22, the second follower rollers 24, the retaining plates 26, the cylinders 30, the third follower rollers 68, the fourth follower rollers 70, the retaining plates 72, and the cylinders 76 are respectively positioned on or above the elongated strip articles 14, 14', . . . . Each of the retaining plates 26 is retained by the single pivotal shaft 28 while each of the retaining plates 72 is retained by the single pivotal shaft 74.

Now, an operation of the feed unit 1 will be described. First, the intermittent driving roller 44 and the intermittent follower roller 46 intermittently convey the elongated strip articles 14 at a predetermined timing, and the print head 48 reciprocates above the plurality of elongated strip articles 14, 14', . . . , thereby printing on the articles simultaneously. Then, the elongated strip articles 14 are conveyed to the drier unit 50 where ink on the articles 14 are dried and hardened. At this step, each of the elongated strip articles 14 is pulled in upstream and downstream directions with proper tension by sets of dancer rollers 38 and 58.

Each upstream-side dancer roller 38 moves down when the corresponding elongated strip article 14 is fed from the feed bobbin 12 at a high speed and the lengths of slack of the article 14 increases excessively. Before the dancer roller 38 moves down abnormally, the first sensors 40 detect that the dancer roller 38 has reached the lower limit position and the signal is transmitted to the cylinder 30. Then, a piston of the cylinder 30 is pushed down, so that the retaining plate 26 swings about the pivotal shaft 28 counterclockwise in FIG. 2, and then the second follower roller 24 moves down and is pushed against the second driving roller 20 through each elongated strip article 14. Then, the elongated strip article 14 is conveyed at a rotation speed of the second driving roller 20. Because the second driving roller 20 rotates at a lower speed than the first driving roller 18, a feeding speed of the article 14 from the feed bobbin 12 decreases. Furthermore, the second driving roller 20 rotates at a lower speed than the intermittent driving roller 44 of the conveying section, and a feeding amount of the elongated strip article 14 by the second driving roller 20 is smaller than a feeding amount of the elongated strip article 14 by the intermittent driving roller 44. Therefore, the dancer roller 38 does not move down lower than the first sensors 40, and then the length slack of the elongated strip article 14 gradually decreases so that the dancer roller 38 moves up.

Before the dancer roller 38 moves up abnormally, the second sensors 42 detect that the dancer roller 38 has reached the upper limit position and the signal is transmitted to the cylinder 30. Then, a piston of the cylinder 30 is pulled up so that the retaining plate 26 swings about the pivotal shaft 28 clockwise in FIG. 2, then the first follower roller 22 moves down and is pushed against the first driving roller 18 through each elongated strip article 14. Then, the elongated strip article 14 is conveyed at a rotation speed of the first driving roller 18. Because the first driving roller 18 rotates at a higher speed than the second driving roller 20, a feeding speed of the article 14 from the feed bobbin 12 increases. Furthermore, the first driving roller 18 rotates at a higher speed than the intermittent driving roller 44, and a feeding amount of the elongated strip article 14 by the first driving roller 18 is larger than a feeding amount of the elongated strip article 14 by the intermittent driving roller 44. Therefore, the dancer roller 38 does not move higher than the second sensors 42, and the length slack of the elongated strip article 14 gradually increases and the dancer roller 38 moves down.

At this time, because the first driving roller 18 and the second driving roller 20 are arranged at the levels slightly lower than the rollers 16 and 32 and are lower than conveying faces of the elongated strip articles 14, the elongated strip articles 14 do not come into contact with the second driving roller 20 when the elongated strip articles 14 are carried by the first driving roller 18, while the elongated strip articles 14 do not come into contact with the first driving roller 18 when the elongated strip articles 14 are carried by the second driving roller 20.

Similarly, each downstream-side dancer roller 58 moves down when the corresponding elongated strip articles 14 are slowly fed toward the take-up roller and the lengths of slack of the articles 14 increase excessively. When the dancer roller 58 reaches the lower limit position, the corresponding third sensors 60 detect that the dancer roller 58 has reached the lower limit position and the signal is transmitted to the cylinder 76. Then, a piston of the cylinder 76 is pulled up, so that the retaining plate 72 swings about the pivotal shaft 74 in a clockwise direction, and the third follower roller 68 moves down and is pushed against the third driving roller 64 through each elongated strip article 14. Then, the elongated strip article 14 is conveyed at a rotation speed of the third driving roller 64. Because the third driving roller 64 rotates at a higher speed than the fourth driving roller 66 and the intermittent driving roller 44, a feeding speed of the article 14 to the take-up roller increases. Therefore, the dancer roller 58 does not move down lower than the third sensors 60, and the lengths of slack of the elongated strip articles 14 gradually decrease so that the dancer roller 58 moves up.

When the dancer roller 58 reaches the upper limit, the corresponding fourth sensors 62 detect that the dancer roller 58 has reached the upper limit position and the signal is transmitted to the cylinder 76. Then, a piston of the cylinder 76 is pushed down, the retaining plate 72 swings about the pivotal shaft 74 in a counterclockwise direction, so that the fourth follower roller 70 moves down and is pushed against the fourth driving roller 66 through each elongated strip article 14, and then the elongated strip article 14 is conveyed at a rotation speed of the fourth driving roller 66. Because the fourth driving roller 66 rotates at a lower speed than the third driving roller 64 and the intermittent driving roller 44, a feeding speed of the article 14 to the take-up roller decreases. Therefore, the dancer roller 58 does not move higher than the fourth sensors 62, and the lengths of slack of the elongated strip articles 14 gradually increase so that the dancer roller 58 moves down.

Because the third driving roller 64 and the fourth driving roller 66 are arranged at the positions slightly lower than the rollers 56 and 78 and are lower than conveying faces of the elongated strip articles 14, the elongated strip articles 14 do not come into contact with the fourth driving roller 66 when the elongated strip articles 14 are carried by the third driving roller 64, while the elongated strip articles 14 do not come into contact with the third driving roller 64 when the elongated strip articles 14 are carried by the fourth driving roller 66.

According to the feed unit 1 of the embodiment, a plurality of elongated strip articles 14 can be accurately fed while preventing generation of slack or excessive tension of the articles 14, thereby accurately printing fine patterns on the elongated strip articles 14 by the ink jet printer. Because the slack and the excessive tension which are different depending on the respective elongated strip article 14 are individually adjusted to keep the tension of each the article 14 constant, tensions of the long articles 14 can be separately adjusted even if a width, a thickness, material, or the like is different depending on the article 14, so that printing can be applied to the articles 14 efficiently. Because a balanced tension is applied to the intermittent driving roller 44 disposed in the vicinity of the print head 48 by the upstream and downstream dancer rollers 38 and 58, there is less resistance to driving, so that the resistance does not affect the print driving. The dancer rollers 38 and 58 can be maintained at the proper positions by detecting the upper and lower limit positions of the dancer rollers 38 and 58 by the first sensors 40, the second sensors 42, the third sensors 60, and the fourth sensors 62, by means of automatically selecting the first driving roller 18 or the second driving roller 20 and the third driving roller 64 or the fourth driving roller 66 respectively rotating at different speeds, and adjusting the conveying speed of the elongated strip articles 14.

The processor of the invention is not limited to the configuration of the above embodiment, but the number of rollers of the feed unit can be varied properly. Also, the shape of each retaining plate 26, 72 each mounted with the two follower rollers may be such a shape as a triangle and an angular U, as far as the two follower rollers can be reliably switched from and to each other. Further, the speeds of the driving rollers can be varied properly, in which case the roller rotating at the lower speed may be a retainer such as a retaining table which completely stops the elongated strip articles.

According to the elongated-strip-article processor of the invention, the plurality of elongated strip articles which are laid in the ink jet printer or the like can be respectively conveyed accurately, and can be treated accurately. Therefore, treatment such as printing can be individually and simultaneously applied to the elongated strip articles with different thicknesses, widths, materials, or the like. Furthermore, the processor can be operated continuously so that efficiency of the operation can be increased.

What is claimed:

1. An elongated-strip-article processor comprising:

(a) a processing section for applying printing to a plurality of continuous elongated strip articles along conveying passages of the elongated strip articles by an ink jet printer;

(b) a conveying section disposed in a vicinity of the processing section for intermittently conveying the elongated strip articles by a predetermined length;

(c) tension adjusting sections respectively disposed upstream and downstream out of a range of the conveying passages including the processing section and the conveying section for adjusting tension of each of the elongated strip articles at a constant value;

(d) sensors respectively provided at the tension adjusting sections for detecting a length of slack of each of the elongated strip articles; and (e) feed sections disposed respectively upstream of the upstream-side tension adjusting section and downstream of the downstream-side tension adjusting section so as to correspond to the individual elongated strip articles, each feed section being adapted to switch between increasing the feed of each elongated strip article and decreasing the feed of each elongated strip article based on detection signals from the respective sensors.

2. An elongated-strip-article processor according to claim 1, wherein each of the feed sections includes a driving roller disposed under each of the elongated strip articles and having a rotation axis perpendicular to a feed direction of the elongated strip articles, at least one retainer disposed under the plurality of the elongated strip articles and in parallel to the driving roller for retaining the elongated strip articles, a plurality of follower rollers disposed above the elongated strip articles and in parallel to the driving roller, and a plurality of retaining members above the elongated strip articles so as to face the retainer via the elongated strip articles, the follower rollers or the retaining members being adapted to be alternatively pressed against the driving roller or the retainer so as to clamp the elongated strip articles between the follower rollers and the driving roller or between the retaining members and the retainer.

3. An elongated-strip-article processor according to claim 2, wherein said retainer is at least one driving roller, said retaining members comprise follower rollers, and each of the feed sections includes a pair of driving rollers both having rotation axes perpendicular to a feed direction of the elongated strip articles and adapted to rotate at different speeds, a plurality of pairs of follower rollers disposed in parallel to the respective driving rollers via the elongated strip articles and adapted to be alternatively pressed against the respective driving rollers to clamp the elongated strip articles between one of each pair of the follower rollers and one of the driving rollers, and a moving means for pressing each pair of the follower rollers against the elongated strip articles.

4. An elongated-strip-article processor according to claim 3, wherein the numbers of said pairs of follower rollers and said moving means correspond to each single driving roller and the number of the plurality of the elongated strip articles.

5. An elongated-strip-article processor according to claim 3, wherein each pair of follower rollers of said feeding section is rotatably retained at both ends of an actuator and that said moving means is attached to one end portion of said actuator for pivotal movement.

6. An elongated-strip-article processor according to claim 1, wherein the processing section includes a print head and a drier unit, and the conveying section is a print roller.

7. An elongated-strip-article processor comprising:

(a) a processing section for applying printing to a plurality of continuous elongated strip articles along conveying passages of the elongated strip articles by an ink jet printer;

(b) a conveying section disposed in a vicinity of the processing section for intermittently conveying the elongated strip articles by a predetermined length;

(c) first and second tension adjusting sections, the first tension adjusting section disposed upstream of the processing and conveying sections along the conveying passages and the second tension adjusting section disposed downstream of the processing and conveying sections along the conveying passages, each of the first and second tension adjusting sections comprising dancer rollers that are mounted to be in contact with upper sides of the elongated strip articles;

(d) a plurality of sensors provided at the first and second tension adjusting sections, the sensors capable of detecting a position of each dancer roller, thereby detecting a length of slack of each of the elongated strip articles; and (e) first and second feed sections, the first feed section disposed upstream of the first tension adjusting section along the conveying passages and the second feed section disposed downstream of the second tension adjusting section along the conveying passages, the first feed section comprising first and second driving rollers disposed under each of the elongated strip articles, the second driving roller rotating slower than the first driving roller, the second feed section comprising third and fourth driving rollers disposed under each of the elongated strip articles, the fourth driving roller rotating slower than the third driving roller; and (f) wherein the first feed section is adapted to switch the speed of the elongated strip articles upstream of the processing and conveying sections to and from the respective rotational speeds of the first and second driving rollers based on detection signals from the respective sensors, and wherein the second feed section is adapted to switch the speed of the elongated strip articles downstream of the processing and conveying sections to and from the respective rotational speeds of the third and fourth driving rollers based on detection signals from the respective sensors.

8. The elongated-strip-article processor of claim 7 further comprising a plurality of pairs of follower rollers disposed above the elongated strip articles, each follower roller facing one of the first, second, third, or fourth driving rollers through one of the elongated strip articles, and each follower roller capable of being alternatively pressed against its respective driving roller so as to clamp the respective elongated strip article between that follower roller and that driving roller so that the elongated strip article is conveyed at the rotational speed of that driving roller.

9. The elongated-strip-article processor of claim 8 further comprising moving means for pressing each follower roller against its respective driving roller to clamp the respective elongated strip article between that follower roller and that driving roller, wherein each pair of follower rollers is rotatably retained at both ends of an actuator, and wherein the moving means is attached to one end portion of the actuator for pivotal movement.

10. The elongated-strip-article processor of claim 7 wherein the processing section comprises a print head and a drier unit, and the conveying section comprises an intermittent driving roll and an intermittent follower roller.

* * * * *